US011349270B2

(12) United States Patent
Zhou et al.

(10) Patent No.: US 11,349,270 B2
(45) Date of Patent: May 31, 2022

(54) MODULAR LAMP

(71) Applicant: DONGGUAN THAILIGHT SEMICONDUCTOR LIGHTING CO., LTD, Dongguan (CN)

(72) Inventors: Wenbo Zhou, Dongguan (CN); Fengqiang Qiu, Dongguan (CN)

(73) Assignee: DONGGUAN THAILIGHT SEMICONDUCTOR LIGHTING CO., LTD, Dongguan (CN)

( * ) Notice: Subject to any disclaimer, the term of this patent is extended or adjusted under 35 U.S.C. 154(b) by 181 days.

(21) Appl. No.: 16/878,648

(22) Filed: May 20, 2020

(65) Prior Publication Data

US 2021/0210916 A1 Jul. 8, 2021

(30) Foreign Application Priority Data

Jan. 2, 2020 (CN) ..... 202010001020.6

(51) Int. Cl.
*H01R 13/52* (2006.01)
*H01R 13/621* (2006.01)
(Continued)

(52) U.S. Cl.
CPC ..... *H01R 33/94* (2013.01); *F21V 21/00* (2013.01); *F21V 21/005* (2013.01); *F21V 23/00* (2013.01);
(Continued)

(58) Field of Classification Search
CPC ..... H01R 33/94; H01R 13/52; H01R 13/62; H01R 13/625; H01R 33/05;
(Continued)

(56) References Cited

U.S. PATENT DOCUMENTS 4,399,371 A * 8/1983 Ziff ..... H02G 3/00 307/147
7,080,927 B2 * 7/2006 Feuerborn ..... F21S 2/005 362/238

(Continued)

*Primary Examiner* — Renee S Luebke
*Assistant Examiner* — Matthew T Dzierzynski

(57) ABSTRACT

The present invention discloses a modular lamp, including several modular units and lamp connectors, where the modular unit is a single lamp, and the lamp connector is configured to connect to the modular unit; and a male connector terminal on either side of each lamp connector is electrically plug-connected to a female connector terminal of one modular unit. In the present invention, female connector terminals connected to a power cable and a control cable are disposed on the modular unit, matched male connector terminals are disposed on the lamp connector, and the lamp connector is directly plug-connected to multiple modular units, so that the multiple modular units can be simultaneously physically and electrically connected to obtain the modular lamp. In this way, diversified lighting requirements can be met by adding different installation accessories to the modules. In addition, assembly operations can be completed by simply performing plugging and unplugging operations, without needing a professional to perform cable-connection and cable-routing between the modular units. Special scenario requirements such as good lighting effects and high ambient temperatures can be met by adjusting module power.

15 Claims, 15 Drawing Sheets

(51) Int. Cl.

| | |
|---|---|
| ***F21V 21/00*** | (2006.01) |
| ***H01R 35/00*** | (2006.01) |
| ***F21V 23/00*** | (2015.01) |
| ***H01R 13/512*** | (2006.01) |
| ***F21V 21/005*** | (2006.01) |
| ***H01R 33/94*** | (2006.01) |
| ***H01R 13/62*** | (2006.01) |
| ***H01R 33/05*** | (2006.01) |
| ***H01R 31/06*** | (2006.01) |

(52) U.S. Cl.
CPC ..... *H01R 13/512* (2013.01); *H01R 13/52* (2013.01); *H01R 13/5202* (2013.01); *H01R 13/62* (2013.01); *H01R 13/6215* (2013.01); *H01R 31/06* (2013.01); *H01R 33/05* (2013.01); *H01R 35/00* (2013.01)

(58) Field of Classification Search
CPC ..... H01R 13/5202; H01R 13/6215; H01R 31/06; H01R 35/00; H01R 13/512; H01R 13/41; H01R 13/514; H01R 9/24; F21S 2/005; F21V 21/005; F21V 23/06; F21V 21/30; F21V 21/34; F21V 23/0442; F21V 29/75; Y10S 362/80; F21Y 2105/10; F21Y 2115/10
See application file for complete search history.

(56) References Cited

U.S. PATENT DOCUMENTS

| | | | | |
|---|---|---|---|---|
| 7,160,140 | B1 * | 1/2007 | Mrakovich | G09F 13/22 439/417 |
| 7,175,306 | B2 * | 2/2007 | Pan | F21V 21/0808 362/240 |
| 7,429,186 | B2 * | 9/2008 | Mrakovich | H01R 13/7175 439/404 |
| 7,690,816 | B2 * | 4/2010 | Tyson | F21S 8/00 362/294 |
| 7,854,616 | B2 * | 12/2010 | Janos | F21S 2/00 439/76.1 |
| 8,111,022 | B2 * | 2/2012 | Snijder | F21V 23/06 315/312 |
| 8,371,894 | B1 * | 2/2013 | Rosen | A63H 33/108 446/91 |
| 8,529,110 | B2 * | 9/2013 | Tsukamoto | F21S 43/19 362/544 |
| 9,046,232 | B2 * | 6/2015 | Melzner | F21S 2/005 |
| 9,188,324 | B2 * | 11/2015 | Jelinek | F21K 9/20 |
| 10,161,594 | B2 * | 12/2018 | Zhou | F21V 5/007 |
| 10,845,046 | B2 * | 11/2020 | Kohen | F21S 8/086 |
| 2001/0024368 | A1 * | 9/2001 | Henrici | F21S 2/005 362/235 |
| 2018/0119940 | A1 * | 5/2018 | Zhou | F21V 21/30 |

* cited by examiner

MODULAR LAMP

TECHNICAL FIELD

The present invention relates to the field of lamp technologies, and specifically, to a modular lamp.

BACKGROUND

LED lamps can be applied to various scenarios such as indoor lighting for restaurants, shopping malls, and homes and outdoor lighting for parks, stadiums, and mining operations. Therefore, the LED lamps have different power specifications to meet lighting requirements of different occasions.

Conventionally, lamps with different power each are molded integrally, and lamps with different power need to be molded separately. For example, a lamp with power of 100 w and a lamp with power of 200 w need to be manufactured by using two corresponding molds. To meet various lighting requirements (for example, lighting for a small indoor living room and lighting for a large outdoor garden), users need to purchase multiple lamps with different power, and manufacturers and suppliers need to configure lamps with all types of power during production and goods preparation, resulting in very high manufacturing costs and warehousing costs and a great reduction in profits.

Assembling multiple single lamps can meet different lighting requirements to a certain extent. Currently, there are some modular lamps in the industry, mainly including the following types:

(1) Multiple single lamps are fastened together by using only physical connectors (such as metal connecting pieces and bolts), which can multiply lighting effects. However, only physical connection is implemented, power is still supplied to the lamps separately, and multiple power supplies are needed on site. As a result, time-consuming power-on and power-off operations are inevitable, on-site routing of numerous cables is messy, and jointing and assembly/disassembly of the lamps are also troublesome.

(2) Power cables of multiple lamps are connected to implement electrical connection, so that the multiple single lamps are integrated into a modular lamp with the multiple single lamps electrically connected to each other. In this case, power needs to be supplied only to a main power cable led out from the module, and only one power supply is needed on site. This modular lamp also has great disadvantages: (1) Cable-connection between the lamps and cable-routing inside the lamps are highly specialized work and need to be completed by a professional, and therefore are difficult for ordinary consumers/users to complete. On one hand, costs of hiring a professional are very high. On the other hand, the ordinary users cannot assemble the lamps by themselves, causing poor user experience. In addition, cable-connection needs to be completed in advance, and almost cannot be performed on a lamp installation site. After the cable-connected modular lamp is sent to the installation site, the users cannot assemble/disassemble the modular lamp again, causing great inconvenience. For example, a user needs 200 w lighting, and a manufacturer needs to hire a professional to connect two 100 w single lamps to form a 200 w modular lamp at relatively high labor costs. If the lighting requirement of the user is reduced to 100 w someday, it is difficult for the user to disassemble the modular lamp. The modular lamp is no more applicable, causing waste and inconvenience. (2) The single lamps are fastened together, and limited by the cable-connection between the lamps, during installation, a lighting range can be adjusted only by changing an installation position, and an angle between the lamps cannot be adjusted flexibly. Consequently, the modular lamp cannot implement wider-range or more concentrated lighting. (3) A user cannot adjust lighting power of each single lamp based on an actual requirement because the power of each single lamp is set before delivery, and a power adjustment controller is usually sealed inside the lamp. Consequently, more diversified and personalized lighting requirements cannot be met. If a customer has different requirements on ambient temperatures and lighting effects in different usage scenarios, requirements for good lighting effects and high ambient temperatures cannot be met through power adjustment.

SUMMARY

To overcome the disadvantages in the prior art, the present invention is intended to provide a modular lamp, including modular units and lamp connectors. Female connector terminals are disposed on the modular unit, matched male connector terminals are disposed on the lamp connector, and the lamp connector is directly plug-connected to different modular units, so that the modular units are connected and electrized, that is, the multiple modular units are connected to constitute a modular lamp.

The present invention is implemented by using the following technical solutions:

A modular lamp includes several modular units and lamp connectors, where the modular unit is a single lamp, and the lamp connector is configured to connect the modular units; the modular unit includes a lamp housing, a power supply drive, a power cable, a control cable, female connector terminals, and an LED lamp bead plate, the power cable is connected to an external power supply, the power cable, the power supply drive, and the LED lamp bead plate are sequentially electrically connected to implement lighting, the power supply drive and the LED lamp bead plate are built in the lamp housing, a female receptacle for accommodating the female connector terminal is disposed on either side of the back of the modular unit, one female connector terminal is disposed in each female receptacle, the female connector terminals are configured to connect to different lamp connectors, each female connector terminal includes a power cable terminal and a control cable terminal, the power cable terminal is connected to the power cable, and the control cable terminal is connected to the control cable; the lamp connector includes a connector body, a power cable, a control cable, and male connector terminals, the male connector terminals match the female connector terminals of the modular unit, a male receptacle for accommodating the male connector terminal is disposed on either side of the connector body, one male connector terminal is disposed in each male receptacle, the male connector terminals are configured to enable the connector body to connect to two modular units simultaneously, each male connector terminal includes a power cable terminal and a control cable terminal, two ends of the power cable are respectively connected to two power cable terminals, and two ends of the control cable are respectively connected to two control cable terminals; and the male connector terminals on either side of each lamp connector are electrically plug-connected to the female connector terminals of one modular unit.

Further, the modular unit includes a power adjustment controller, the power adjustment controller is connected to the power supply drive by using the control cable, and is configured to adjust power of the LED lamp bead plate, the power adjustment controller is built in the lamp housing, and an adjustment potentiometer of the power adjustment controller leads to a side portion of the female connector terminal on one side, and is located in the female receptacle on the one side.

Further, the modular unit includes a lens, and the lens is fastened above the LED lamp bead plate.

Further, the modular unit includes a female terminal fastener, the female terminal fastener is fastened in the female receptacle, and both the female connector terminal and the adjustment potentiometer are fastened on the female terminal fastener.

Further, a first positioning rod is disposed in the female receptacle, a first positioning hole is disposed on the female terminal fastener, and the female terminal fastener is fastened in the female receptacle via the first positioning hole.

Further, a fastening bolt hole is disposed on a side portion of the female receptacle.

Further, the connector body includes a first body and a second body, one male connector terminal is disposed on each of the first body and the second body, and the first body and the second body are rotatably connected.

Further, an inside portion of the second body has a cylindrical surface, and an inside portion of the first body has an arc surface adapted to fit the cylindrical surface to rotate; a sleeve groove with a cylindrical surface is further disposed on the inside portion of the second body, an arc-shaped sleeve portion is further disposed on the inside portion of the first body, and the sleeve portion is adapted to fit the sleeve groove to rotate; and an adjustable bolt hole for installing an adjustable bolt is disposed on the sleeve groove, a bolt sliding groove is disposed on the sleeve portion, and the first body and the second body are rotatably fit and are fastened together or released from each other by using the adjustable bolt.

Further, anti-slip stripes at a specific interval are disposed on the periphery of the bolt sliding groove on the sleeve portion.

Further, several angle label stripes are disposed on the sleeve portion, the angle label stripes are located on the outside of the anti-slip stripes, there is a constant angular distance between the angle label stripes, reference stripes are further disposed on the second body, and the reference stripes are disposed on side portions of the angle label stripes.

Further, the lamp connector includes a male terminal fastener, the male terminal fastener is disposed in the male receptacle, and the male connector terminal is fastened on the male terminal fastener.

Further, a second positioning rod is disposed in the male receptacle, a second positioning hole for fitting the second positioning rod is disposed on the male terminal fastener, and the male terminal fastener is installed in the male receptacle via the second positioning hole.

Further, the lamp connector includes a waterproof stopper, the waterproof stopper is of an integrally molded structure, one end of the waterproof stopper is connected to an end portion of the first body, and the other end of the waterproof stopper is connected to an end portion of the second body.

Further, the lamp connector includes stopper bolts, one end of the waterproof stopper is connected to the end portion of the first body by using one stopper bolt, the other end of the waterproof stopper is connected to the end portion of the second body by using another stopper bolt, and the waterproof stopper and the second body are rotatably connected by tightening or loosening the stopper bolt.

Further, several guide holes are further disposed on the connector body, and fastening bolts for fastening to the modular units are disposed in the guide holes.

Compared with the prior art, the present invention can achieve the following beneficial effects: The female connector terminals connected to the power cable and the control cable are disposed on the modular unit, the matched male connector terminals are disposed on the lamp connector, and the lamp connector is directly plug-connected to multiple modular units, so that the multiple modular units can be simultaneously physically and electrically connected to obtain the modular lamp, to meet diversified lighting requirements. In the present invention, assembly operations can be completed by simply performing plugging and unplugging operations, without needing a professional to perform cable-connection and cable-routing between the modular units. Therefore, the operations are simple and quick, an ordinary consumer can also fast complete the operations without needing any professional knowledge, and labor costs of hiring a professional for cable-connection are greatly reduced. In addition, cable-connection does not need to be completed for a modular lamp in advance anymore, and it is only necessary to send the lamp and the connector in the present invention to an installation site, to perform on-site assembly based on an actual situation. When a lighting requirement changes, the quantity of lamps can be increased or decreased to meet the requirement, thereby improving universality and use experience.

In the figures: 10. Modular unit; 11. Lamp housing; 111. Female receptacle; 112. First positioning rod; 113. Fastening bolt hole; 12. Power supply drive; 13. Female connector terminal; 14. LED lamp bead plate; 15. Power control controller; 151. Adjustment potentiometer; 16. Lens; 17. Female terminal fastener; 171. First positioning hole; 20. Lamp connector; 21. Connector body; 211. First body; 2111. Sleeve portion; 2112. Bolt sliding groove; 2113. Anti-slip stripe; 2114. Angle label stripe; 212. Second body; 2121. Sleeve groove; 2122. Adjustable bolt hole. 2123. Reference stripe; 213. Second positioning rod; 214. Male receptacle; 22. Male connector terminal; 23. Male terminal fastener; 231. Second positioning hole; 24. Adjustable bolt; 25. Waterproof stopper; 26. Stopper bolt; 27. Fastening bolt; 30. External power cable; 40. External control cable; 50. Sealing cover.

DESCRIPTION OF EMBODIMENTS

The following further describes the present invention with reference to the accompanying drawings and specific implementations. It should be noted that, the following described embodiments or technical features may be randomly combined to constitute new embodiments provided that they do not conflict with each other.

The present invention discloses a modular lamp. Referring to FIG. 1 to FIG. 4, the modular lamp includes several modular units 10 and lamp connectors 20. The modular unit 10 is a single lamp, and the lamp connector 20 is configured to connect different modular units 10.

Figure 1:
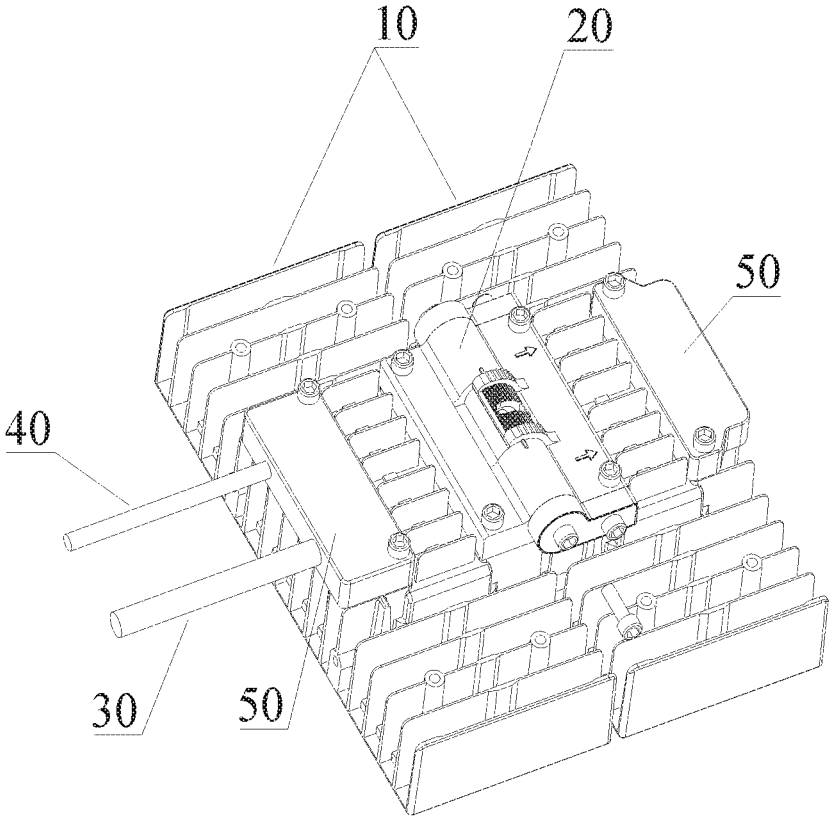
FIG. 1 is a schematic three-dimensional diagram of a modular lamp.
Figure 2:
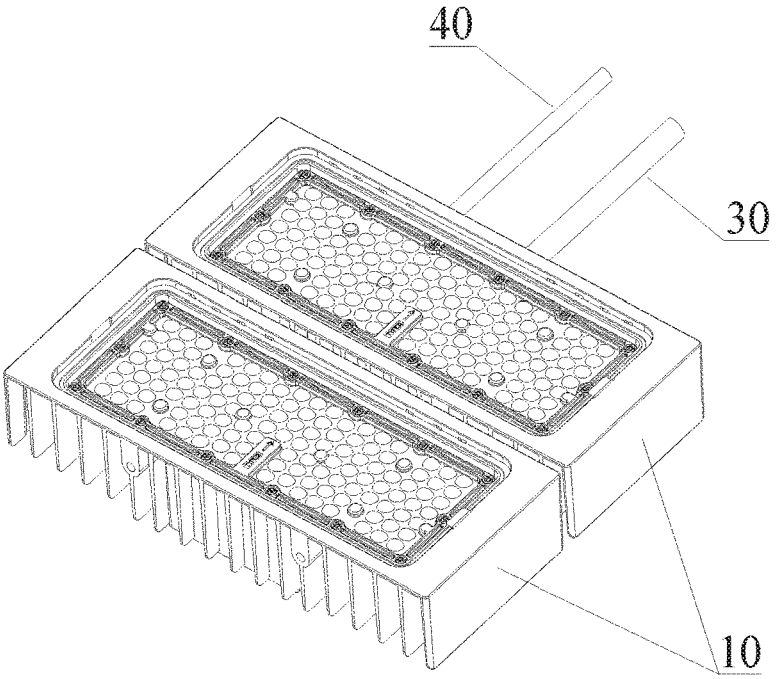
FIG. 2 is another schematic three-dimensional diagram of a modular lamp.
Figure 5:
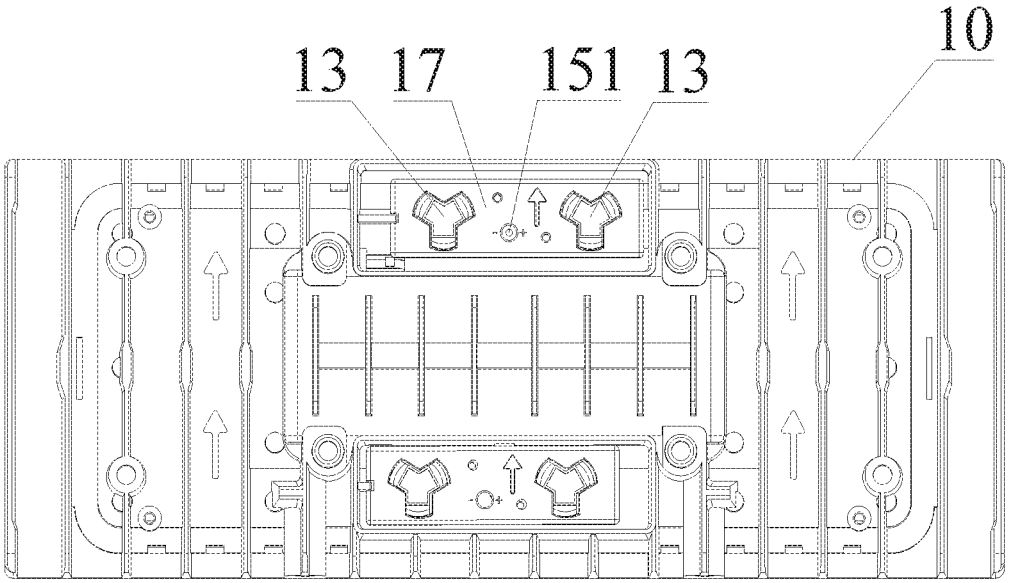
FIG. 5 is a bottom view of a modular unit.
Figure 6:
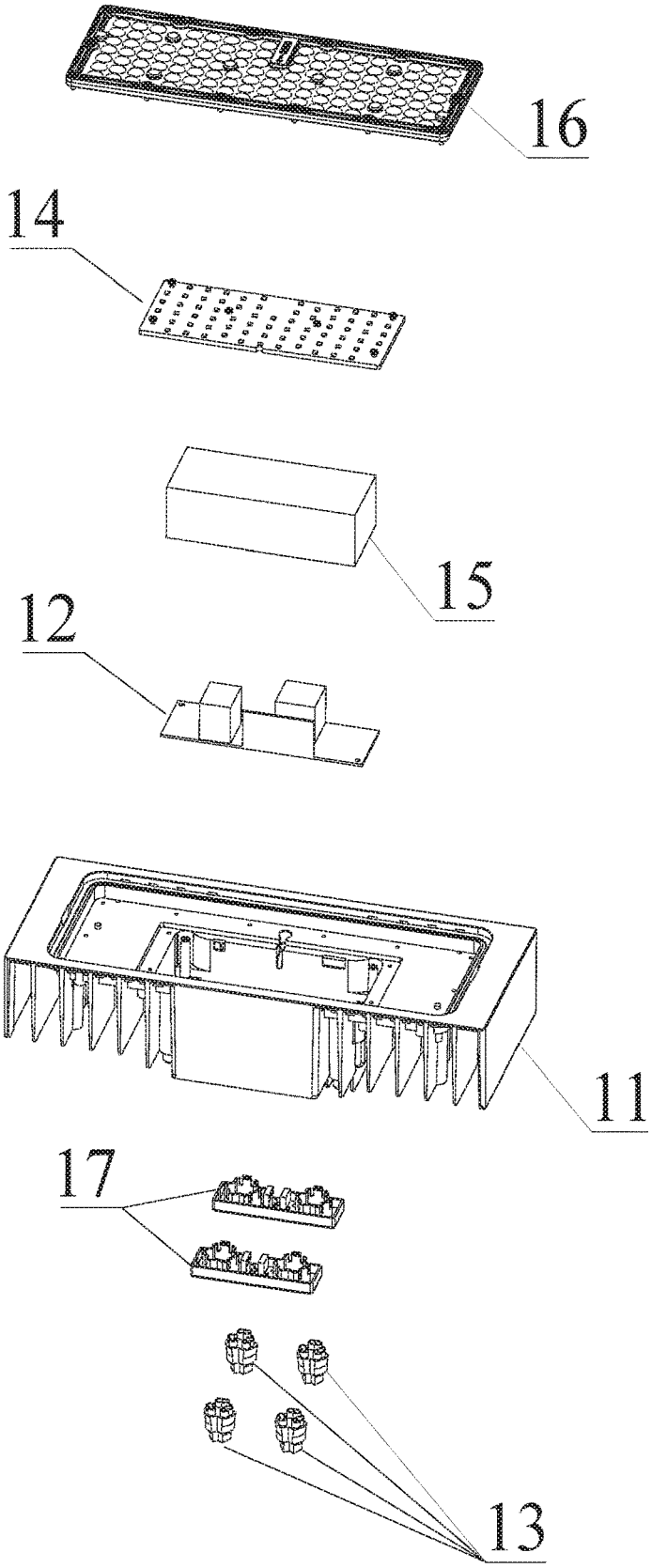
FIG. 6 is an exploded view of a modular unit.

Referring to FIG. 6, the modular unit 10 includes a lamp housing 11, a power supply drive 12, a power cable, a control cable, female connector terminals 13, and an LED lamp bead plate 14. Referring to FIG. 1 and FIG. 2, one end of the power cable is connected to an external power supply, where the external power supply may be a mains, another power supply device, or a power supply unit, the other end of the power cable is connected to the modular unit 10, one end of the control cable is connected to an external central control device, or may not be connected to the external central control device if a user has no control requirement, and the other end of the control cable is connected to the modular unit 10. In FIG. 1 and FIG. 2, an external power cable 30 and an external control cable 40 are shown, and cables connected to the modular unit 10 are not shown. The power cable, the power supply drive 12, and the LED lamp bead plate 14 are sequentially electrically connected to meet basic lighting requirements. The power supply drive 12 and the LED lamp bead plate 14 are built in the lamp housing 11. This part is the prior art. Referring to FIG. 5, a female receptacle 111 for accommodating the female connector terminal 13 is disposed on either side of the back of the modular unit 10, one female connector terminal 13 is disposed in each female receptacle 111, and the female connector terminals 13 are configured to connect to different lamp connectors 20. Each female connector terminal 13 further includes a power cable terminal and a control cable terminal, the power cable terminal is connected to the power cable, and the control cable terminal is connected to the control cable. Therefore, the female connector terminal 13 is equivalent to an interface of the power cable and the control cable of the modular unit 10.

Figure 9:
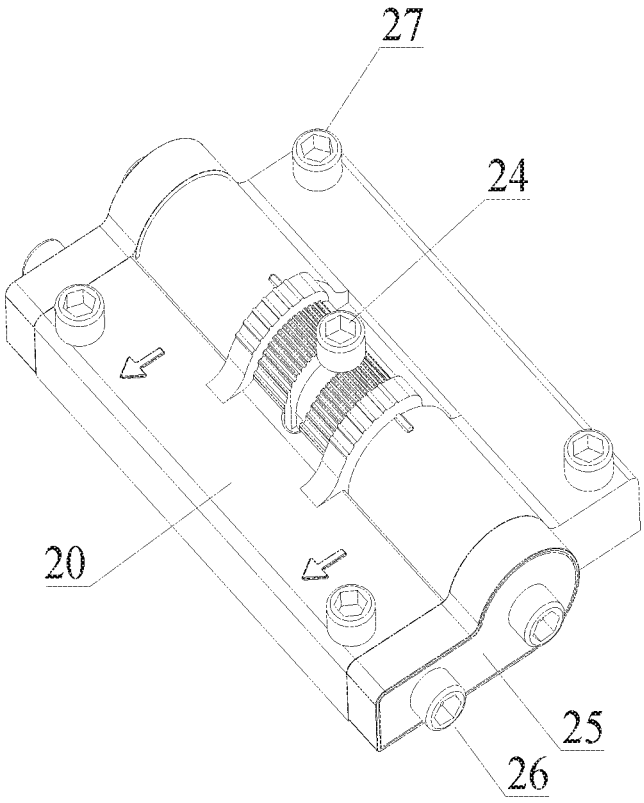
FIG. 9 is a schematic three-dimensional diagram of a lamp connector.
Figure 10:
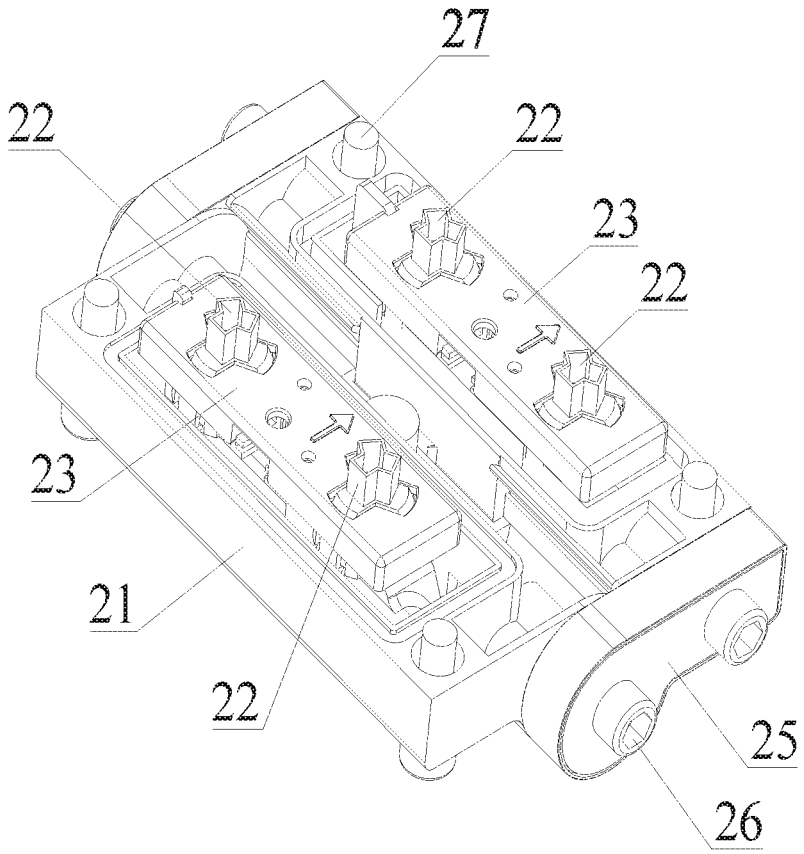
FIG. 10 is another schematic three-dimensional diagram of a lamp connector.
Figure 11:
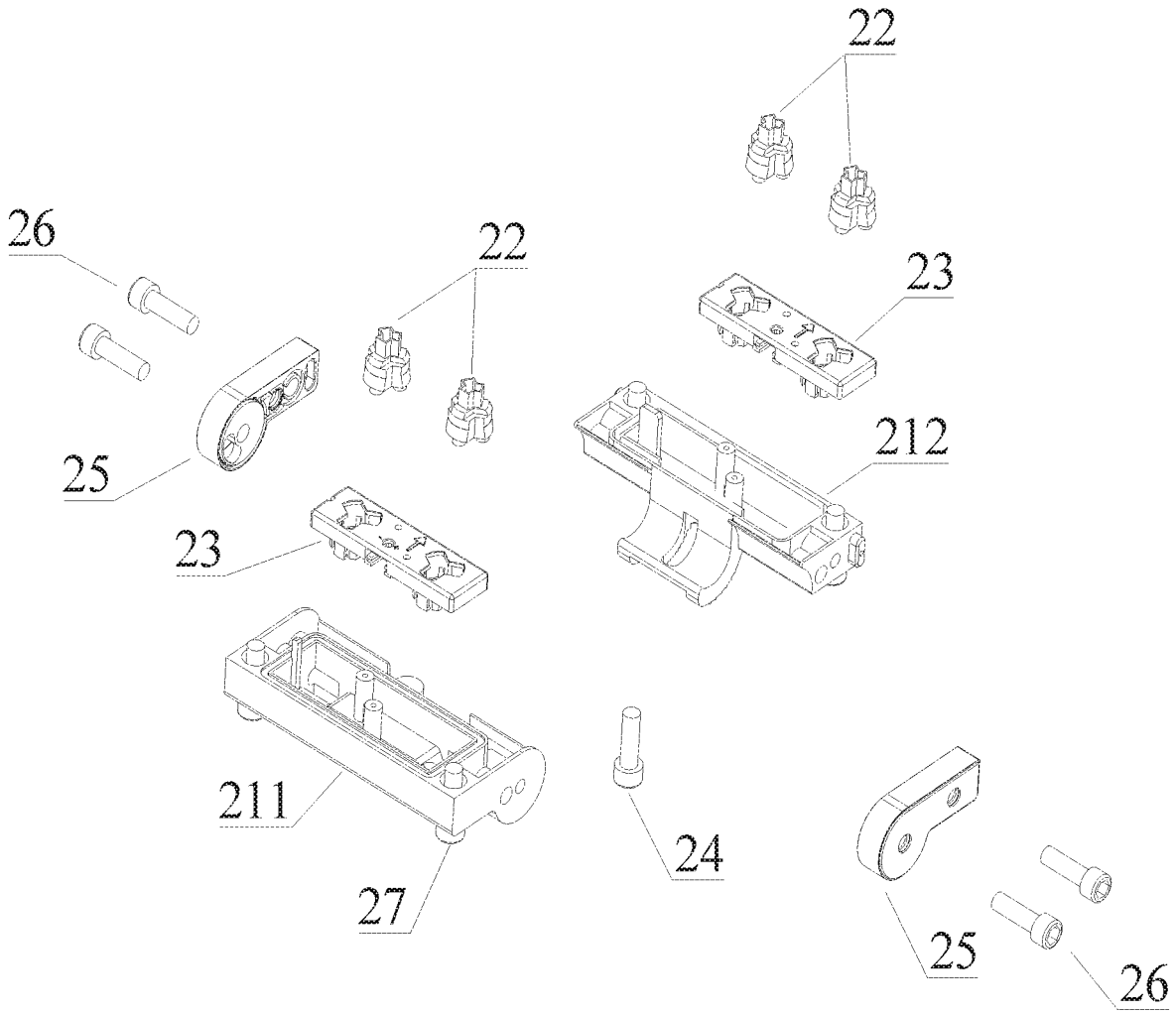
FIG. 11 is an exploded view of a lamp connector.
Figure 16:
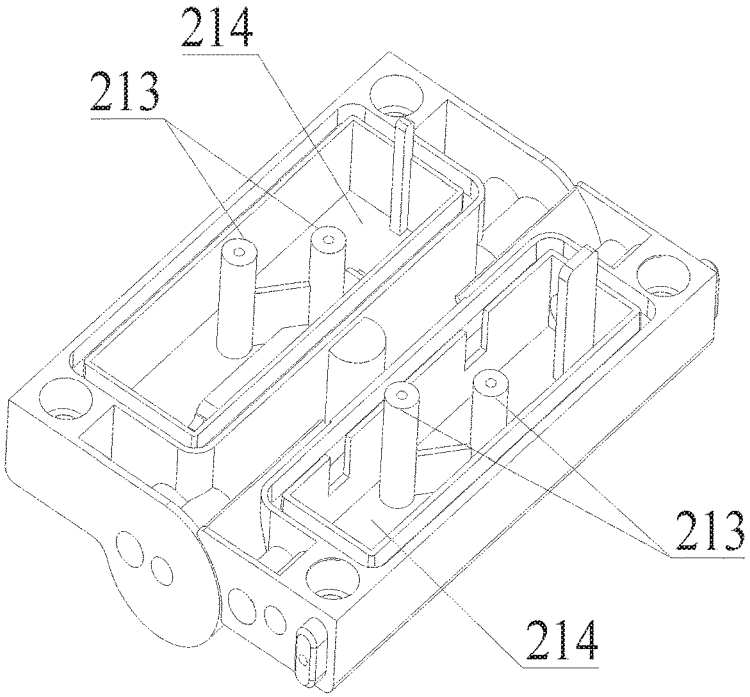
FIG. 16 is another schematic diagram of a state in which a first body and a second body fit each other.

Referring to FIG. 9 to FIG. 11, the lamp connector 20 includes a connector body 21, a power cable, a control cable, and male connector terminals 22. The power cable and the control cable of the lamp connector 20 are connected to the male connector terminals 22, and the male connector terminals 22 and the female connector terminals 13 of the lamp match each other, and can be plug-connected to each other. Referring to FIG. 16, a male receptacle 214 is disposed on either side of the connector body 21, and one male connector terminal 22 is disposed in each male receptacle 214 to enable the connector body 21 to connect to two modular units 10 simultaneously. Each male connector terminal 22 further includes a power cable terminal and a control cable terminal. Two ends of the power cable are respectively connected to two power cable terminals, and two ends of the control cable are respectively connected to two control cable terminals. In other words, the male connector terminal 22 is equivalent to an interface of the power cable and the control cable of the lamp connector 20. Both the power cable and the control cable (not shown in the figure) are located inside the connector body 21, and are not exposed.

Figure 3:
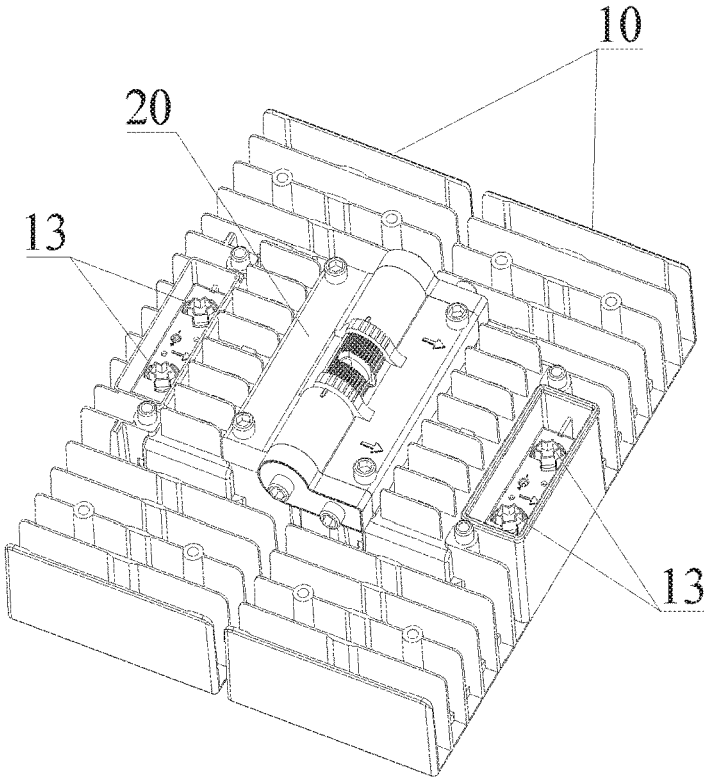
FIG. 3 is a schematic three-dimensional diagram of a modular lamp (a hidden external power cable, an external control cable, and a sealing cover)
Figure 4:
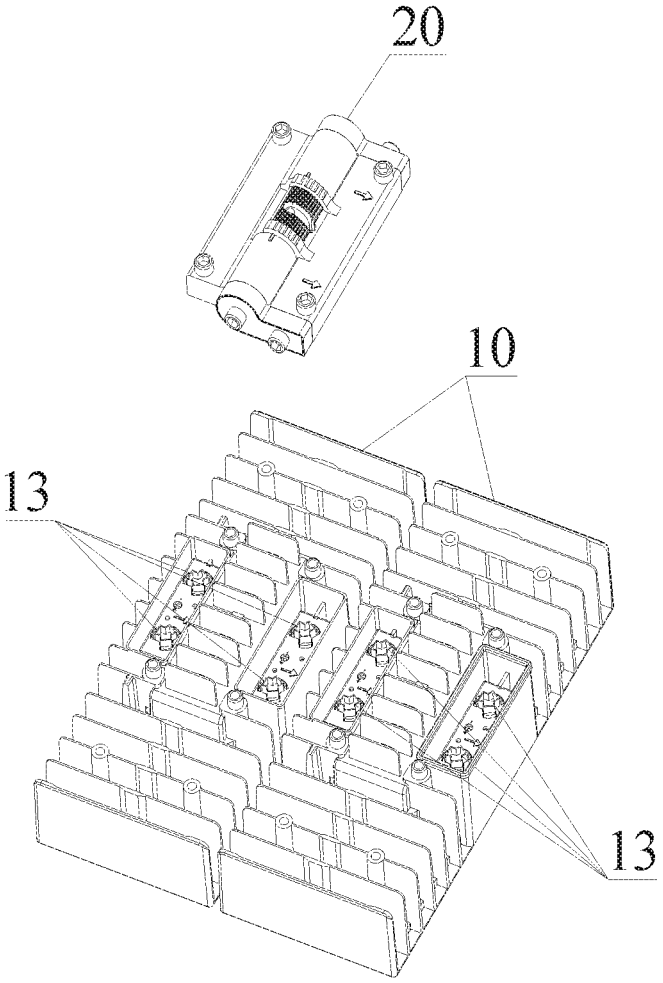
FIG. 4 is an exploded schematic diagram of a modular unit and a lamp connector.

A connection relationship between the modular unit 10 and the lamp connector 20 is as follows: Referring to FIG. 3 and FIG. 4, the male connector terminals 22 on either side of the lamp connector 20 are electrically plug-connected to female connector terminals 13 of one modular unit 10. In other words, in addition to being physically connected to the modular units 10, the lamp connector 20 can be used as an adapter to connect cables of two modular units 10. The connection is implemented by plug-connecting the male connector terminals and the female connector terminals, and there is no need to perform complex cable connection operations on the modular units 10.

FIG. 1 to FIG. 4 show a modular lamp that includes two modular units 10 and one lamp connector 20, and the modular lamp is merely an example for description. A modular lamp with different power can be constituted by selecting another quantity of modular units 10 and lamp connectors 20. For example, two 100 W modular units 10 and one lamp connector 20 can constitute a 200 W modular lamp, and three 200 W modular units 10 and two lamp connectors 20 can constitute a 600 W modular lamp. The quantity of modular units 10 and the quantity of lamp connector 20 are not limited in the present invention.

Figure 7:
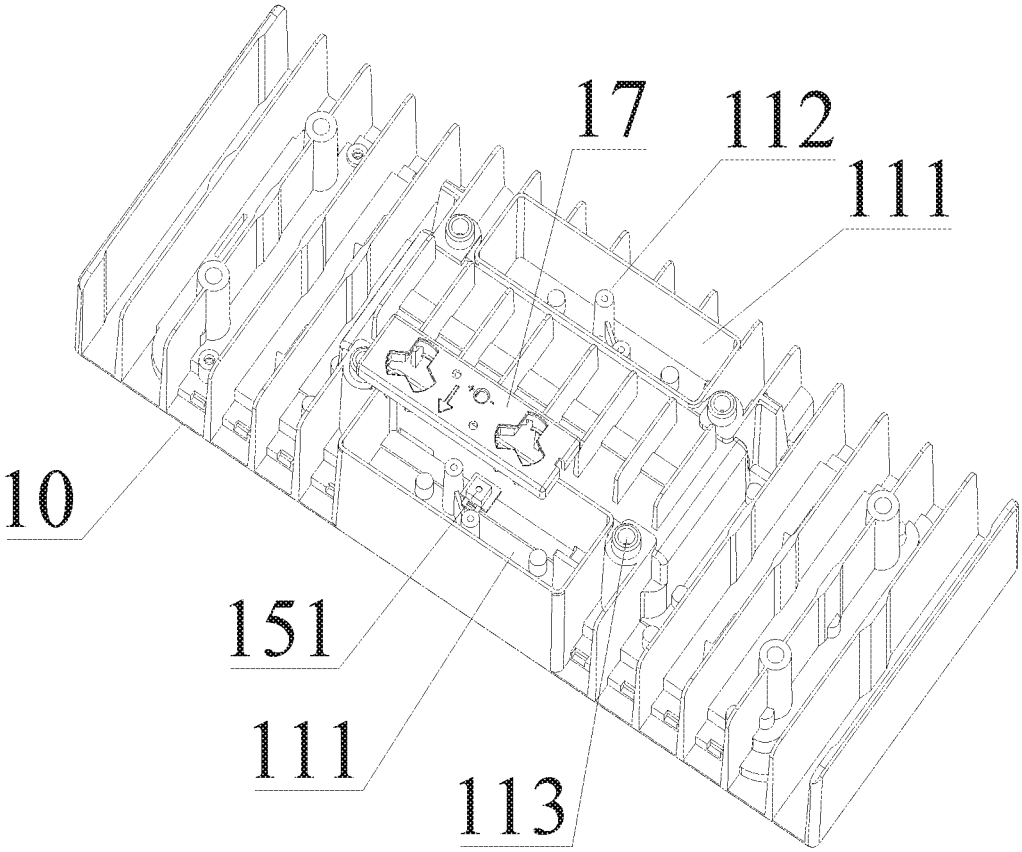
FIG. 7 is an exploded schematic diagram of a lamp housing and a female terminal fastener.

Specifically, the modular unit 10 provided in the present invention further has a power adjustment function. Referring to FIG. 5, FIG. 6, and FIG. 7, a power adjustment controller 15 is disposed in the modular unit 10. The power adjustment controller 15 is connected to the power supply drive 12 by using the control cable, and is built in the lamp housing 11. In addition, an adjustment potentiometer 151 of the power adjustment controller 15 leads to a side portion of the female connector terminal 13 on one side, and is located in the female receptacle 111 on the one side. The female connector terminal 13 needs to be plug-connected to the male connector terminal 22, and therefore it can be learned that the female receptacle 111 is an open receptacle. Therefore, the adjustment potentiometer 151 disposed in the female receptacle 111 can also be exposed outside the lamp housing 11, which is equivalent to providing a power adjustment interface to a user for manual adjustment. In this case, power of each modular unit 10 can be adaptively adjusted, and overall power of the entire modular lamp can be adjusted in a larger range. For example, two 100 W modular units 10 constitute a 200 W modular lamp. In this case, overall power of the modular lamp can be arbitrarily adjusted in a range from 0 W to 200 W by adjusting power adjustment controllers 15 of the two modular units 10. The power adjustment controller 15 in this embodiment is a component in the prior art, and can be purchased in the market. A composition structure of the power adjustment controller 15 falls beyond the improvement scope of the present invention, and therefore a physical structure and a circuit principle of the power adjustment controller 15 are not described.

Specifically, referring to FIG. 6, the modular unit 10 further includes a lens 16. The lens 16 is fastened above the LED lamp bead plate 14, to improve light concentration and to make light source distribution more uniform. More preferably, the modular unit 10 may further include an outer cover (not shown in the figure). The outer cover is fastened above the lens 16, and is located outside the lamp housing 11 for protection, decoration, and light transmission.

Figure 8:
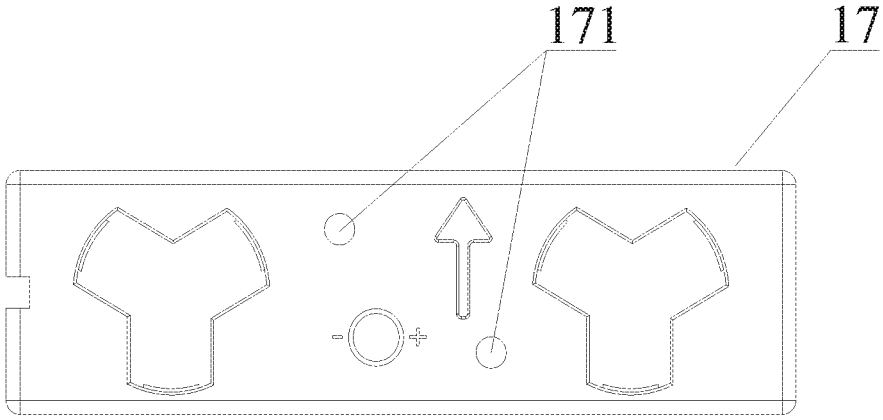
FIG. 8 is a front view of a female terminal fastener.

Specifically, referring to FIG. 8 and FIG. 5, the modular unit 10 further includes a female terminal fastener 17. The female terminal fastener 17 is preferably made of plastic, or may be made of other insulation materials. The female terminal fastener 17 is fastened in the female receptacle 111, both the female connector terminal 13 and the adjustment potentiometer 151 of the power adjustment controller 15 are fastened on the female terminal fastener 17, and the female terminal fastener 17 mainly functions as a support and provides an installation position.

Specifically, referring to FIG. 7, a first positioning rod 112 is further disposed in the female receptacle 111, and a first positioning hole 171 is correspondingly disposed on the female terminal fastener 17. The female terminal fastener 17 is fastened in the female receptacle 111, and rapid positioning and installation is implemented by fitting the first positioning rod 112 and the first positioning hole 171.

Specifically, referring to FIG. 7, fastening bolt holes 113 are further disposed on a side portion of the female receptacle 111, several guide holes are correspondingly disposed on the connector body 21, and fastening bolts 27 for fastening to the modular unit are disposed in the guide holes. After the lamp connector 20 is plug-connected to the lamp, the fastening bolt 27 is used for strengthening, so that the plug-connection is not loose.

Figure 13:
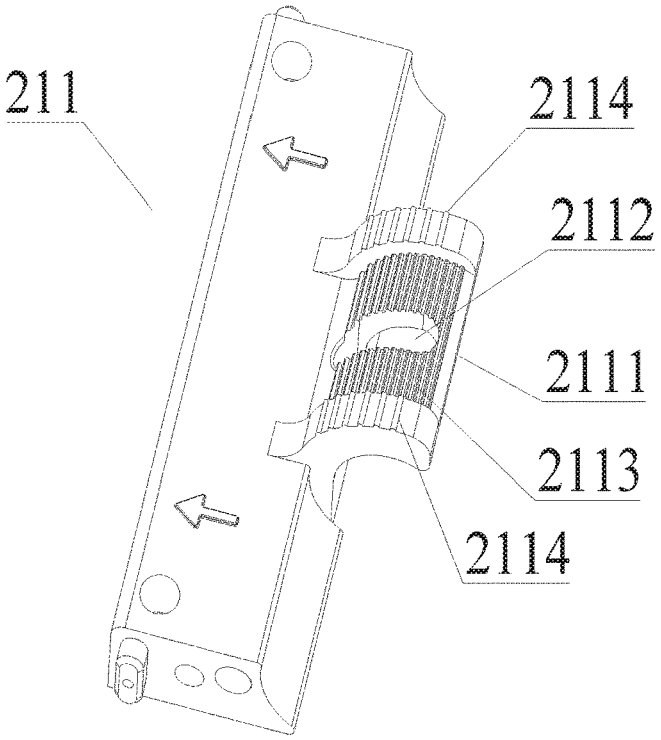
FIG. 13 is a schematic three-dimensional diagram of a first body.
Figure 14:
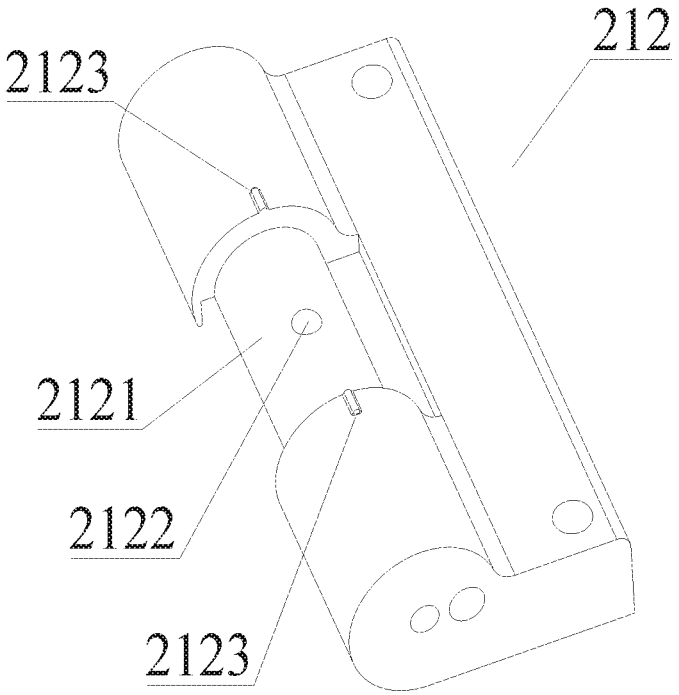
FIG. 14 is a schematic three-dimensional diagram of a second body.
Figure 15:
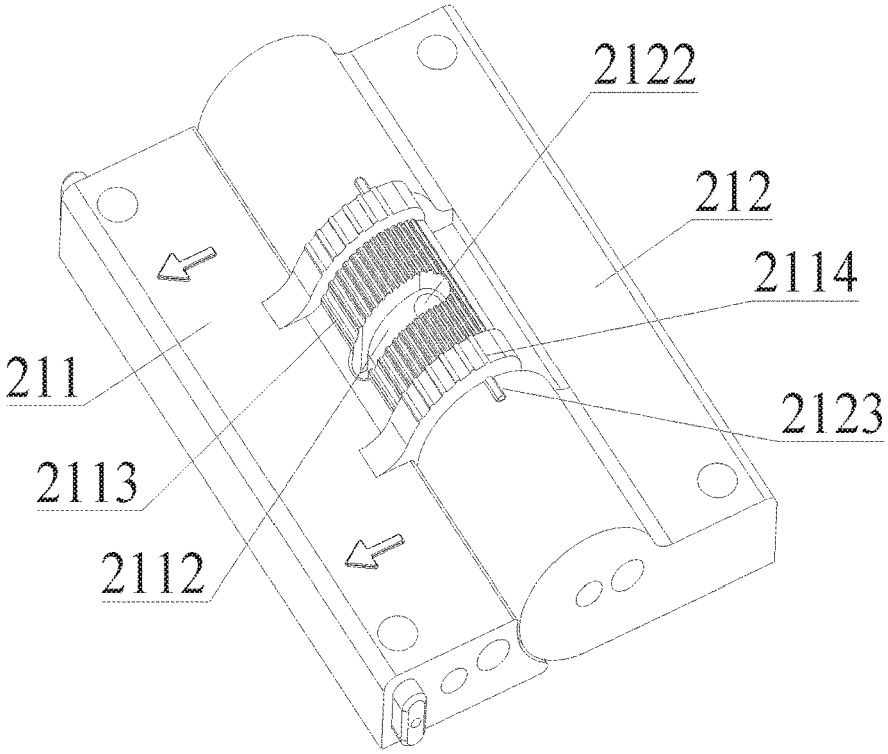
FIG. 15 is a schematic diagram of a state in which a first body and a second body fit each other.

Specifically, for the lamp connector 20, referring to FIG. 13 to FIG. 15, the connector body 21 includes a first body 211 and a second body 212. One male connector terminal 22 is disposed on each of the first body 211 and the second body 212 to connect to one modular unit 10 at each end. The first body 211 and the second body 212 are rotatably connected.

More specifically, in this embodiment, an inside portion of the second body 212 has a cylindrical surface, and an inside portion of the first body 211 has an arc surface adapted to fit the cylindrical surface to rotate. In addition, a sleeve groove 2121 with a cylindrical surface is disposed on the inside portion of the second body 212, the sleeve groove 2121 is of a groove structure, an arc-shaped sleeve portion 2111 is disposed on the inside portion of the first body 211, the sleeve portion 2111 is of an outward protruding structure, and the sleeve portion 2111 and the sleeve groove 2121 are adapted to fit each other to rotate. Therefore, by using the structure, the first body 211 and the second body 212 can fit each other to rotate relatively. In addition, the sleeve groove 2121 is provided with an adjustable bolt hole 2122 for installing an adjustable bolt 24, the sleeve portion 2111 is provided with a bolt sliding groove 2112, and the first body 211 and the second body 212 are fastened or released from each other by using the adjustable bolt 24.

Figure 12:
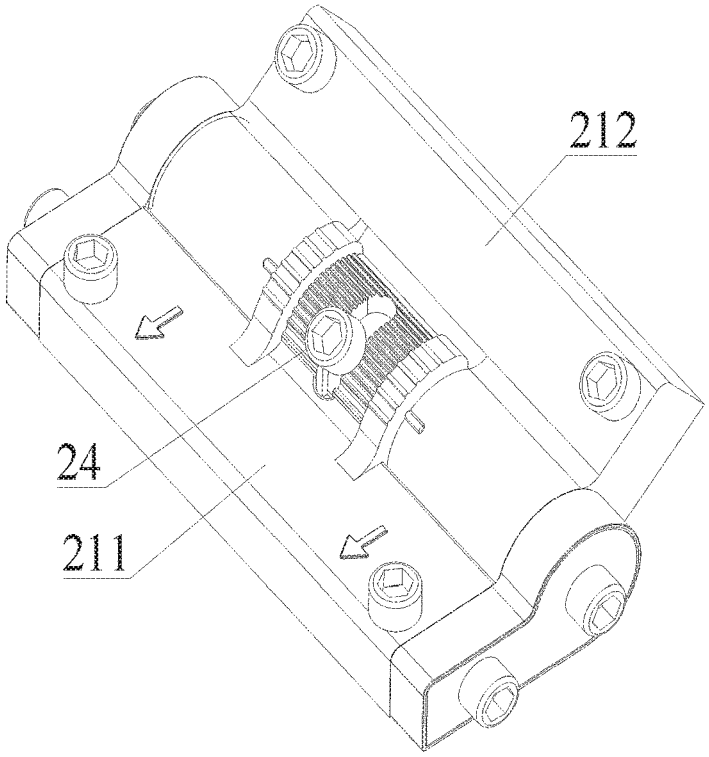
FIG. 12 is a schematic diagram of a rotation state of a lamp connector.

A rotation function of the lamp connector 20 can be implemented by using the foregoing structure. An angle between different lamps can be flexibly adjusted by adjusting the lamp connector through rotation, to change a lighting range of the entire modular lamp, that is, expand the lighting range, or narrow the lighting range to enhance light concentration. Referring to FIG. 12, when the lamp connector 20 is adjusted through rotation, the adjustable bolt 24 is loosened, and the first body 211 and the second body 212 are rotated to change an angle between the first body 211 and the second body 212. The bolt sliding groove 2112 is of a long strip structure, and therefore the adjustable bolt 24 can move in the bolt sliding groove 2112 in the rotation process. After a required angle is obtained through adjustment, the adjustable bolt 24 is tightened again to complete angle adjustment.

Certainly, the foregoing rotation structure embodiment is merely one of rotatable connection manners. Alternatively, rotation can be implemented by co-disposing a central rotation shaft in the first body 211 and the second body 212, or rotation can be implemented by disposing a component such as a hinge between the first body 211 and the second body 212. Any structure commonly used in the mechanical field to equivalently replace the rotation structure in this embodiment falls within the protection scope of the present invention provided that the same technical effect is achieved.

Specifically, referring to FIG. 13, anti-slip stripes 2113 at a specific interval are disposed on the periphery of the bolt sliding groove 2112 on the sleeve portion 2111, to increase friction after the adjustable bolt 24 is tightened, thereby avoiding unstable fastening due to sliding of the adjustable bolt 24.

Specifically, referring to FIG. 13, angle label stripes 2114 are further disposed on the sleeve portion 2111. The angle label stripes 2114 are located on the outside of the anti-slip stripes 2113, and there is a constant angular distance between the angle label stripes 2114. Correspondingly, reference stripes 2123 are further disposed on the second body 212, and the reference stripes 2123 are disposed on side portions of the angle label stripes 2114. Referring to FIG. 15, the reference stripe 2123 is used to accurately and visually show a rotation angle of the connector. When the rotation angle of the connector (between the first body 211 and the second body 212) is 0°, the reference stripe 2123 is aligned with the outermost angle label stripe 2114. There is a constant angular distance between the angle label stripes 2114. After the connector is rotated, a current rotation angle can be learned by viewing the reference stripe 2123 is aligned with which angle label stripe 2114. This is illustrated below by using a specific embodiment.

In an embodiment, there are six angle label stripes 2114, and an angular distance between the angle label stripes 2114 is 10°. When the rotation angle of the connector is 0°, the reference stripe 2123 is aligned with the first angle label stripe 2114 counting from top to bottom. After the connector is rotated, if the reference stripe 2123 is aligned with the third angle label stripe 2114 in this case, the rotation angle is 10°*(3−1)=20°, and so on.

Certainly, both the quantity of angle label stripes 2114 and a value of the angular distance can be changed, and any adjustment made based on an actual requirement falls within the protection scope of the present invention.

Figure 17:
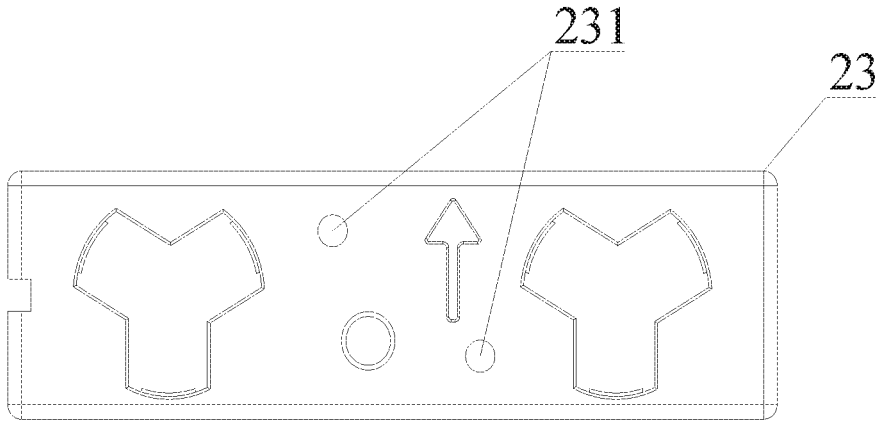
FIG. 17 is a front view of a male terminal fastener.

Specifically, referring to FIG. 10 and FIG. 17, the lamp connector 20 further includes a male terminal fastener 23. The male terminal fastener 23 has the same structure as the female terminal fastener 17. The male terminal fastener 23 is disposed in the male receptacle 214, the male connector terminal 22 is fastened to the male terminal fastener 23, and the male terminal fastener 23 fastens and supports the male connector terminal 22.

More specifically, referring to FIG. 16, a second positioning rod 213 is further disposed in the male receptacle 214. A second positioning hole 231 for fitting the positioning rod is disposed on the male terminal fastener 23, and the male terminal fastener 23 is installed in the male receptacle 214 via the second positioning hole 231 to implement rapid positioning and installation.

Specifically, referring to FIG. 9 to FIG. 11, the lamp connector 20 further includes a waterproof stopper 25. The waterproof stopper 25 is of an integrally molded structure, one end of the waterproof stopper 25 is connected to an end portion of the first body 211, and the other end of the waterproof stopper 25 is connected to an end portion of the second body 212. Because the first body 211 and the second body 212 are rotatably connected, there is a gap between the first body 211 and the second body 212, which allows water or contaminants to enter easily. The waterproof stopper 25 is integrally molded to well block and seal the gap to improve waterproof performance of the lamp connector 20.

More specifically, the lamp connector 20 further includes stopper bolts 26. One end of the waterproof stopper 25 is connected to the end portion of the first body 211 by using one stopper bolt 26; and the other end of the waterproof stopper 25 is connected to the end portion of the second body 212 by using another stopper bolt 26, and the waterproof stopper 25 and the second body 212 are rotatably connected by tightening or loosening the another stopper bolt 26. In other words, when the rotation angle of the lamp connector 20 is adjusted, the stopper bolt 26 at the second body 212 is loosened, to enable the waterproof stopper 25 to rotate relative to the second body 212. After the rotation angle is adjusted, the stopper bolt 26 is tightened again to fasten both ends of the waterproof stopper 25.

Specifically, referring to FIG. 9, several guide holes are further disposed on the connector body 21, and fastening bolts 27 for fastening to the modular unit are disposed in the guide holes. Corresponding fastening bolt holes 113 are disposed on the lamps. After the lamp connector 20 is plug-connected to the lamps, the plug-connection is further enhanced by using the fastening bolts 27, so that the plug-connection is not easy to loosen.

When the lamp connector 20 is in use, first the rotation angle of the lamp connector 20 is adjusted; then the male connector terminals 22 on both ends of the lamp connector 20 are plug-connected to the female connector terminals 13 of the modular units 10; and finally the lamp connector 20 and the modular units 10 are fastened by using the fastening bolts 27 to implement connection between the modular units 10. Based on different use requirements, various modular lamps with different power can be constituted by selecting a corresponding quantity of modular units 10 and lamp connectors 20.

In addition, each of two male connector terminals 22 of each lamp connector 20 is connected to one of the female connector terminals 13 of the modular unit 10 on either side. It can be understood that in the entire modular lamp, left female connector terminals of the leftmost modular unit 10 and right female connector terminals of the rightmost modular unit 10 are always not connected to the lamp connector 20, and are in a non-connected state. To ensure the overall waterproof performance of the module, a sealing cover 50 can be fastened on the two female connector terminals, so that the two non-connected female connector terminals are also sealed.

Based on the detailed descriptions of the foregoing embodiments, it can be understood that in the present invention, direct plug-connection to a lamp is implemented through matching between male connector terminals and female connector terminals, so that both physical connection and electrical connection between multiple lamps can be implemented, and multiple light modules with different power are formed to meet diversified lighting requirements.

The technical effects of the present invention include at least the following: (1) Assembly operations can be completed by simply performing plugging and unplugging operations, without needing a professional to perform cable-connection and cable-routing between the lamps. Therefore, the operations are simple and quick, an ordinary consumer can also fast complete the operations without needing any professional knowledge, and labor costs of hiring a professional for cable-connection are greatly reduced. In addition, cable-connection does not need to be completed for a modular lamp in advance anymore, and it is only necessary to send the lamp and the connector in the present invention to an installation site, to perform on-site assembly based on an actual situation. When a lighting requirement changes, the quantity of lamps can be increased or decreased to meet the requirement, thereby improving universality and use experience. (2) In addition, the lamp connector has the rotation function, so that an angle between the lamps can be adjusted flexibly, to expand a lighting range of the entire module, or to narrow the lighting range to enhance light concentration, thereby meeting more diversified lighting requirements. (3) Power of each modular unit can be adjusted by a user based on a use requirement, and therefore overall power of the modular lamp can be adjusted in a larger range. After a customer buys the modular lamp, if the customer has different requirements on ambient temperatures and lighting effects in different usage scenarios, requirements for good lighting effects and high ambient temperatures can be met through power adjustment. (4) The overall sealing performance and waterproof performance are good.

Figure 18:
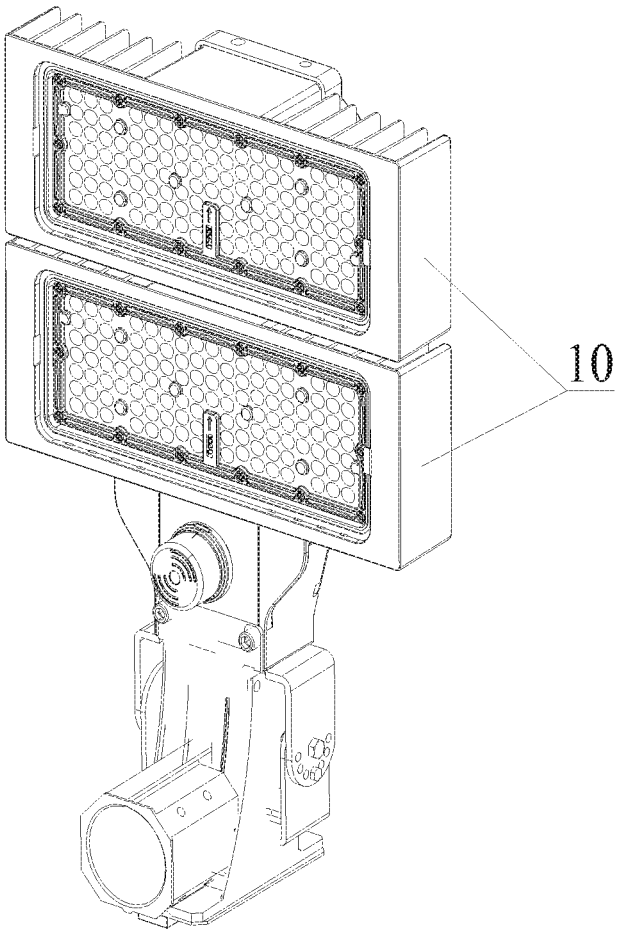
FIG. 18 shows a high-pole lamp assembled with a modular lamp.
Figure 19:
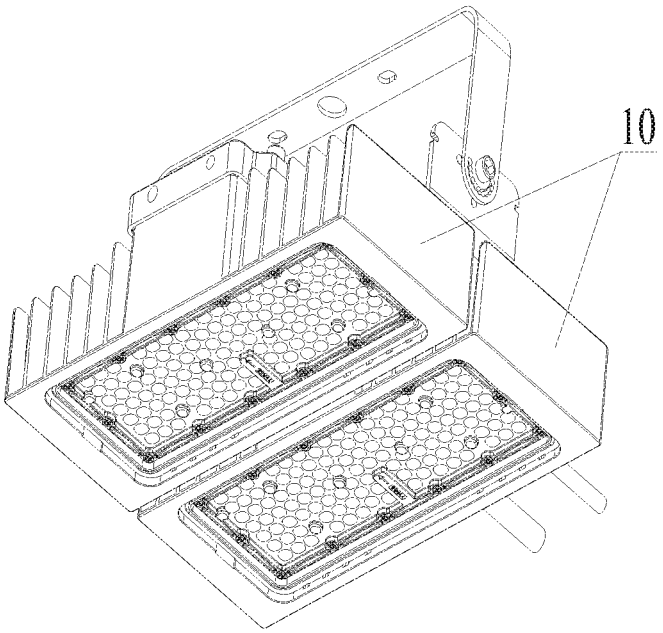
FIG. 19 shows a mining lamp assembled with a modular lamp.
Figure 20:
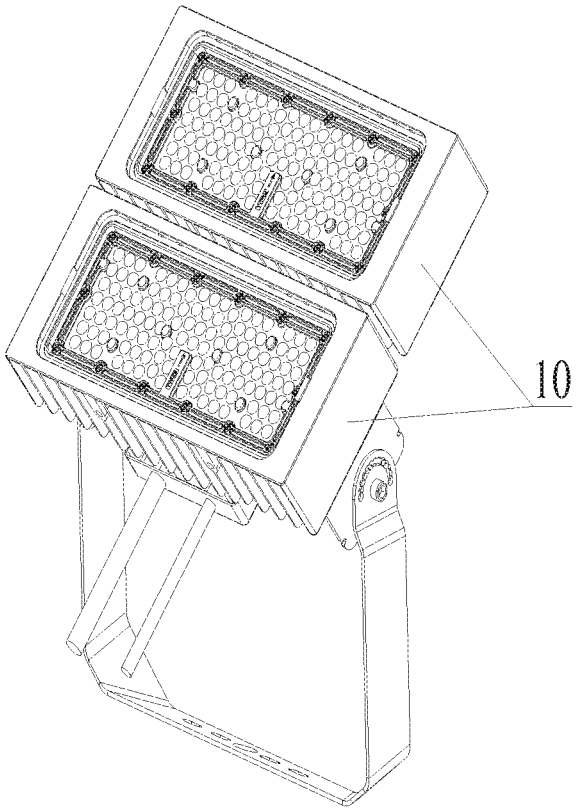
FIG. 20 shows a spotlight lamp assembled with a modular lamp.
Figure 21:
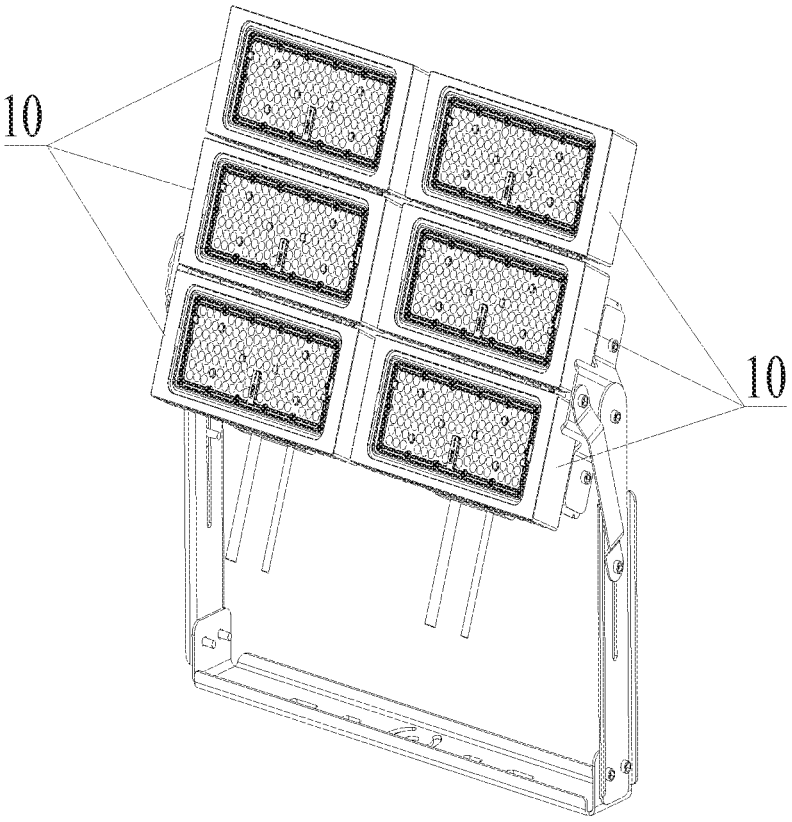
FIG. 21 shows a stadium lamp assembled with a modular lamp.

As an extension, the modular lamp provided in the present invention features high universality, and can be quickly assembled with other accessories to obtain various types of LED lamps. For example, referring to FIG. 18, a high-pole lamp can be assembled by adding a corresponding sealing cover, adapter, bracket, lamp arm, and the like to the modular lamp. Referring to FIG. 19, a mining lamp can be assembled by adding a corresponding sealing cover, adapter, adapter fastener, U-shaped bracket, and the like to the modular lamp. Referring to FIG. 20, a spotlight lamp can be assembled by adding a corresponding sealing cover, adapter, U-shaped bracket, and the like to the modular lamp and fastening the U-shaped bracket on the horizontal plane. Referring to FIG. 21, a stadium lamp can be assembled by adding a corresponding sealing cover, adapter, adapter fastener, stadium lamp bracket, and the like to the modular lamp. Certainly, the foregoing several lamps are merely examples for description. Regardless of the quantity of used modular units and lamp connectors, a lamp in any form or structure assembled with the modular lamp in the present invention falls within the protection scope of the present invention. All of the modular units, lamp connectors, and peripheral accessories are manufactured into standardized products, so that users can independently perform assembly based on requirements, which features high adaptability. In this way, a storage amount can be greatly reduced and production costs can be reduced.

The foregoing implementations are merely preferred implementations of the present invention, and are not intended to limit the protection scope of the present invention. Any non-substantive changes and replacements made by a person skilled in the art based on the present invention fall within the protection scope claimed by the present invention.

What is claimed is:

1. A modular lamp, comprising several modular units and lamp connectors, wherein each modular unit is a single lamp, and each lamp connector is configured to connect the modular units;

each modular unit comprises a lamp housing, a power supply drive, a power cable, a control cable, female connector terminals, and an LED lamp bead plate; the power cable is connected to an external power supply; the power cable, the power supply drive, and the LED lamp bead plate are sequentially electrically connected to implement lighting; the power supply drive and the LED lamp bead plate are built in the lamp housing; a female receptacle for accommodating each female connector terminal is disposed on either side of the back of each modular unit, one female connector terminal is disposed in each female receptacle; the female connector terminals are configured to connect to different lamp connectors; each female connector terminal comprises a power cable terminal and a control cable terminal; the power cable terminal is connected to the power cable, and the control cable terminal is connected to the control cable;

each lamp connector comprises a connector body, a power cable, a control cable, and male connector terminals; the male connector terminals match the female connector terminals of each modular unit; a male receptacle for accommodating each male connector terminal is disposed on either side of the connector body, one male connector terminal is disposed in each male receptacle; the male connector terminals are configured to enable the connector body to connect to two modular units simultaneously; each male connector terminal comprises a power cable terminal and a control cable terminal; two ends of the power cable are respectively connected to two power cable terminals, and two ends of the control cable are respectively connected to two control cable terminals; and the male connector terminals on either side of each lamp connector are electrically plug-connected to the female connector terminals of each modular unit.

2. The modular lamp according to claim 1, wherein each modular unit further comprises a power adjustment controller, the power adjustment controller is connected to the power supply drive by using the control cable, and is configured to adjust power of the LED lamp bead plate; the power adjustment controller is built in the lamp housing, and an adjustment potentiometer of the power adjustment controller leads to a side portion of the female connector terminal on one side, and is located in the female receptacle on the one side.

3. The modular lamp according to claim 2, wherein each modular unit further comprises a female terminal fastener, the female terminal fastener is fastened in the female receptacle, and both the female connector terminal and the adjustment potentiometer are fastened on the female terminal fastener.

4. The modular lamp according to claim 3, wherein a first positioning rod is further disposed in the female receptacle, a first positioning hole is disposed on the female terminal fastener, and the female terminal fastener is fastened in the female receptacle via the first positioning hole.

5. The modular lamp according to claim 1, wherein each modular unit further comprises a lens, and the lens is fastened above the LED lamp bead plate.

6. The modular lamp according to claim 1, wherein a fastening bolt hole is further disposed on a side portion of the female receptacle.

7. The modular lamp according to claim 6, wherein several guide holes are further disposed on the connector body, and fastening bolts for fastening to the modular units are disposed in the guide holes.

8. The modular lamp according to claim 1, wherein the connector body comprises a first body and a second body, one male connector terminal is disposed on each of the first body and the second body, and the first body and the second body are rotatably connected.

9. The modular lamp according to claim 8, wherein an inside portion of the second body has a cylindrical surface, and an inside portion of the first body has an arc surface adapted to fit the cylindrical surface to rotate; a sleeve groove with a cylindrical surface is further disposed on the inside portion of the second body, an arc-shaped sleeve portion is further disposed on the inside portion of the first body, and the sleeve portion is adapted to fit the sleeve groove to rotate; and an adjustable bolt hole for installing an adjustable bolt is disposed on the sleeve groove, a bolt sliding groove is disposed on the sleeve portion, and the first body and the second body are rotatably fit and are fastened together or released from each other by using the adjustable bolt.

10. The modular lamp according to claim 9, wherein anti-slip stripes at a specific interval are disposed on the periphery of the bolt sliding groove on the sleeve portion.

11. The modular lamp according to claim 10, wherein several angle label stripes are further disposed on the sleeve portion, the angle label stripes are located on the outside of the anti-slip stripes, there is a constant angular distance between the angle label stripes, reference stripes are further disposed on the second body, and the reference stripes are disposed on side portions of the angle label stripes.

12. The modular lamp according to claim 8, wherein each lamp connector further comprises a waterproof stopper, the waterproof stopper is of an integrally molded structure, one end of the waterproof stopper is connected to an end portion of the first body, and the other end of the waterproof stopper is connected to an end portion of the second body.

13. The modular lamp according to claim 12, wherein each lamp connector further comprises stopper bolts, one end of the waterproof stopper is connected to the end portion of the first body by using one stopper bolt, the other end of the waterproof stopper is connected to the end portion of the second body by using another stopper bolt, and the waterproof stopper and the second body are rotatably connected by tightening or loosening the stopper bolt.

14. The modular lamp according to claim 1, wherein each lamp connector further comprises a male terminal fastener, the male terminal fastener is disposed in the male receptacle, and the male connector terminal is fastened on the male terminal fastener.

15. The modular lamp according to claim 14, wherein a second positioning rod is further disposed in the male receptacle, a second positioning hole for fitting the second positioning rod is disposed on the male terminal fastener, and the male terminal fastener is installed in the male receptacle via the second positioning hole.

* * * * *